United States Patent [19]

Bissot et al.

[11] 4,436,599

[45] Mar. 13, 1984

[54] METHOD FOR MAKING A CATHODE, AND METHOD FOR LOWERING HYDROGEN OVERVOLTAGE IN A CHLORALKALI CELL

[75] Inventors: Thomas C. Bissot, Newark; Stephen Li, Wilmington, both of Del.

[73] Assignee: E.I. DuPont De Nemours & Company, Wilmington, Del.

[21] Appl. No.: 484,557

[22] Filed: Apr. 13, 1983

[51] Int. Cl.[3] ..... C25B 1/34; C25B 11/04

[52] U.S. Cl. ..... 204/98; 204/181 N; 204/290 R; 204/128; 204/48

[58] Field of Search ..... 204/98, 128, 181 N, 204/290 R, 291, 48

[56] References Cited

U.S. PATENT DOCUMENTS

| | | | |
|---|---|---|---|
| 4,105,516 | 8/1978 | Martinsons et al. | 204/128 |
| 4,160,704 | 7/1979 | Kuo et al. | 204/128 |
| 4,230,543 | 10/1980 | Kawasuki et al. | 204/98 |
| 4,298,447 | 11/1981 | Copeland | 204/252 |
| 4,312,723 | 1/1982 | McIntyre et al. | 204/98 |
| 4,337,127 | 6/1982 | Copelanol | 204/98 |
| 4,339,313 | 7/1982 | Rechlicz | 204/128 |

*Primary Examiner*—R. L. Andrews
*Assistant Examiner*—Terryence Chapman

[57] ABSTRACT

The invention provides an improved process for making an iron-activated cathode for a chloralkali cell, and an improved method for lowering the operating voltage of a chloralkali electrolysis cell, which comprises adding to the cathode compartment of the cell a solution of a water-soluble or caustic-soluble ferrite and passing an electric current through the cell. By virtue of the invention, the hydrogen overvoltage in the cell is lowered, and considerable operating improvement thereby attained.

18 Claims, No Drawings

METHOD FOR MAKING A CATHODE, AND METHOD FOR LOWERING HYDROGEN OVERVOLTAGE IN A CHLORALKALI CELL

FIELD OF THE INVENTION

This invention concerns improvements in and relating to a method for making a cathode for a chloralkali cell, and a method for lowering the hydrogen overvoltage of a chloralkali cell.

BACKGROUND OF THE INVENTION

Production of caustic and chlorine by electrolysis of brine is well known in the art. The electrolysis is carried out in an electrolytic cell which consists in general of an anode, a cathode, an anode compartment and a cathode compartment. In one of the more recent types of such an electrolytic cell, the two compartments are separated from one another by a fluorine-containing cation exchange membrane.

Such an electrolytic cell can be operated more efficiently and economically as the current efficiency is increased, and as the operating voltage is lowered. Inasmuch as very large quantities of caustic and chlorine are produced by electrolysis of brine daily, even a very small improvement in the current efficiency or operating voltage of chloralkali cells will lead to saving of large amounts of money and conservation of large amounts of energy.

The operating voltage of a chloralkali cell is made up of a number of component parts, of which one is that part of the voltage drop at the cathode known as the hydrogen overvoltage. A lowering of the hydrogen overvoltage will result in lowering of the overall cell voltage and consequently make the process more economical.

In U.S. Pat. No. 4,105,516, a method for electrolyzing brine with an iron cathode at a lowered cell voltage is disclosed wherein an electrolytic hydrogen evolution catalyzing transition metal is added to the catholyte liquor while carrying out the electrolysis. One example is to add a solution of ferrous chloride to the catholyte compartment. However, the effect is not lasting, and to maintain the effect the transition metal must be repeatedly added at intervals ranging from 7 or 10 days down to as often as 6 hours. It is therefore necessary to provide for separating the transition metal which contaminates the product caustic.

In U.S. Pat. No. 4,160,704, a method for reducing the cathodic hydrogen overvoltage potential in a chloralkali cell is disclosed wherein a solution of metal ions selected from a group which includes iron, cobalt and others, all in the form of cations, is introduced into the catholyte solution, and a current is passed to plate the metal ions onto the cathode. In this method, the solution of combined metal cations was fed into the cathode compartment for many (20) hours, or was recirculated through the cathode compartment over a period of one hour; in such procedures, however, the ferrous cations added would precipitate as insoluble ferrous hydroxide when there is any caustic in the cathode compartment unless a complexing agent such as tartrate is also present. Alternatively, an iron element was placed in the cathode compartment, or a cathode chamber fabricated of stainless steel was employed; in the latter case after 27 days of operation, the overpotential of the cathode had been lowered, but the cathode chamber itself was corroded.

In U.S. Pat. No. 4,298,447, a cathode which lowers hydrogen overvoltage in chloralkali electrolysis is disclosed which has particles consisting essentially of crystals of alpha-iron adherent to the surface of a cathode substrate; the method disclosed is the placing of a cathode substrate, a specified electrolyte and particles comprising grains of alpha-iron in an electrical apparatus, and passing an electrical current; the electrical apparatus can be a membrane-type chloralkali cell. However, it has now been found that this method has the disadvantages that (1) a portion of the iron particles added to the cathode compartment is discharged from the cell along with the caustic product, (2) some of the iron particles form a sludge in the bottom of the cathode compartment, and (3) some of the iron particles have, at times, adhered to the ion-exchange membrane and caused iron deposits in the membrane which, in sufficient amount, can cause delamination of the membrane and an increase in the voltage.

It is therefore an object of this invention to provide an improved method for making an iron-activated cathode for a chloralkali cell.

It is another object of this invention to provide a method for lowering the hydrogen overvoltage of a chloralkali cell.

SUMMARY OF THE INVENTION

The above objects are accomplished by the present invention which, briefly, comprises in one embodiment a method for making an iron-activated cathode by adding to an operating chloralkali cell a solution which contains iron in anions consisting of $Fe^{II}$, oxygen, and possibly hydrogen, characterized by a blue-green color, usually referred to as ferrite ions.

More specifically, according to the present invention there is provided a process for making an iron-activated cathode from the cathode of a chloralkali cell which comprises an anode compartment, an anode situated within said anode compartment, a cathode compartment, a cathode situated within said cathode compartment, and a cation-exchange membrane between said anode compartment and said cathode compartment, said anode compartment containing aqueous brine solution, said cathode compartment containing aqueous caustic solution, said process comprising (a) introducing into said cathode compartment an aqueous solution containing ferrite ions, and
(b) passing an electrical current between said anode and said cathode until a deposit comprising iron forms on the surface of said cathode.

There is also provided according to the present invention a method for lowering the operating voltage of a chloralkali electrolysis cell which comprises an anode, a cathode, an anode compartment, a cathode compartment, and a fluorine-containing cation-exchange membrane which separates said compartments, said method comprising introducing into said cathode compartment an aqueous solution containing ferrite ions.

There is further provided in a process for electrolysis of brine in a chloralkali cell which comprises an anode, a cathode, an anode compartment, a cathode compartment, and a fluorine-containing cation-exchange membrane which separates said compartments, the improvement comprising adding to said cathode compartment an aqueous solution containing ferrite ions.

DETAILED DESCRIPTION OF THE INVENTION

In accordance with the invention, a solution which contains $Fe^{II}$ bound in an anion, such as ferrite ion, is added to the catholyte in a chloralkali cell.

As is well known in the art, the principal and essential components of a membrane-type chloralkali cell are an anode compartment, an anode situated in that compartment, a cathode compartment, a cathode situated in that compartment, and a cation-exchange membrane situated between, and separating, those two compartments. An aqueous brine such as saturated sodium chloride solution is fed to the anode compartment, and water or dilute caustic to the cathode compartment. Caustic and hydrogen are formed in the cathode compartment, and chlorine, along with depleted brine, is obtained from the anode compartment.

The invention is applicable with a wide variety of different types and shapes of cathodes. Examples include nickel, stainless steel, mild steel and mild steel having a nickel surface, such as nickel plating or Raney nickel, in the form of sheets, rods or expanded metal. Electrodes having a Raney nickel surface are described, for example, in U.S. Pat. Nos. 4,116,804; 4,169,025; and 3,637,437.

The invention is useful with chloralkali cells containing any of the known types of cation exchange membranes suitable for use in a membrane-type cell. Such membranes of fluorine-containing polymers include those disclosed in U.S. Pat. Nos. 3,282,875; 4,085,071; 4,176,215; and 4,267,364 and South African patent publication 78/002225, or fabricated from polymers described therein, but are not limited thereto.

Although the invention is applicable over a wide range of cell operating conditions, it ordinarily finds greatest use in cells operating at a current density of 7.5 to 50 amps per $dm^2$ (i.e., from below 0.5 to greater than 3 amps per square inch), at 75° to 90° C., while producing caustic at a concentration of 10 to 40% by weight, with an exit brine concentration of 15 to 25% by weight.

In most typical chloralkali cells of the membrane type of commercial size, the spacing between the anode and cathode is narrow, i.e., of the order of 2 to 8 mm. When the cell is assembled for use, the membrane can be mounted equidistant from the two electrodes, or closer to the anode or cathode, but is preferbly closer to the anode. Because of possible swelling of the membrane in the aqueous medium and/or deformation of the membrane due to varying pressure in either the catholyte or anolyte, the membrane may actually contact either the anode or cathode. One preferred manner of operation is such that the cathode is spaced away from the membrane by a nominal distance, generally about 1 to 6 mm, which spacing can be maintained, e.g., by maintaining the catholyte at a suitably higher pressure than the anolyte, which presses the membrane against the anode. In another suitable arrangement, the cathodes used are of expanded metal mesh having spacer bars ca. 3 mm thick mounted on the surface which faces the membrane, and the cells are assembled with the membrane ca. 3 mm from the anode surface, and adjacent to the spacer bars of the cathode. In this arrangement the cell is operated with a higher anolyte head, which holds the membrane against the spacer bars, thus providing a fluid gap on both sides of the membrane. The cell can also be of the type referred to as zero-gap; in such a cell, both the anode and cathode are positioned in contact with the cation-exchange membrane, and both are of an open structure, e.g., expanded metal, perforated or microporous, so as to permit the passage of liquids and gases therethrough.

The invention can also be practiced in a cell in which the membrane is any type of surface modified membrane, e.g., a membrane having a layer of electrocatalyst on at least one surface thereof to form a membrane/electrode composite (such as described in published U.K. Patent Application GB No. 2,009,788A); a membrane having thereon a gas- and liquid-permeable porous non-electrode layer (such as described in published U.K. Patent Application GB No. 2,064,586A); or a membrane having a roughened surface (such as described in published U.K. Patent Application GB No. 2,043,108A). A plurality suitable arrangement for the practice of the invention is that wherein a membrane having such non-electrode layer is used in a narrow gap configuration.

Suitable ferrite solutions for use in the invention include those of sodium or potassium ferrite in strong aqueous caustic solution, the caustic being, e.g., 40 to 50% by weight sodium hydroxide or 40 to 52% by weight potassium hydroxide. Most suitably, the solution is an aqueous solution. Such solutions can be made in known manner by heating a strong caustic solution with particles of iron. Any unreacted iron particles are easily removed by filtering or centrifuging. The resulting ferrite solution is best stored out of contact with air to preclude destruction of ferrite ions by oxidation. The chemical formula for sodium ferrite is sometimes shown as $Na_4FeO_3$, and is sometimes shown as $Na_4[Fe(OH)_6]$. The ferrite ion can further be represented at $FeO_2^=$ or $HFeO_2^-$. There is, moreover, some discrepancy in the chemical literature as to the use of the term ferrite, which has sometimes been used in reference to anions which contain $Fe^{III}$ as well as to anions which contain $Fe^{II}$. Herein, use of the term "ferrite" as employed by Cotton & Wilkinson (see below) is adopted, and refers to the anion which contains $Fe^{II}$.

The amount of ferrite to be added to the catholyte does not appear to be critical. Amounts of solution added to the catholyte corresponding to as low as 2 g $Fe/m^2$ of included area of cathode (10 g of sodium ferrite/$m^2$ of included area of cathode) to as high as 70 g $Fe/m^2$ of included area of cathode (350 g of sodium ferrite/$m^2$ of included area of cathode) have proved effective in lowering hydrogen overvoltage by a significant amount. By "included area" of a cathode is meant the overall area included by the outline of the cathode (of generally flat configuration or deformed into a generally flat configuration). Reductions in voltage effected have ranged from 0.1 to 0.4 volts relative to that of a comparable cell with an unmodified cathode, or to that before addition of ferrite is made. Operation of the cathode at lowered voltage continues for an extended period of time with little or no degradation of performance; such improved operation has been demonstrated for 80 days without need for any further addition of ferrite to maintain such improved performance.

The ferrite solution is best added in such manner that (1) it will not contact air so as to avoid oxidation of the ferrite ion, and (2) it will not be diluted by water, as dilution to below about 32% caustic results in precipitation of ferrous hydroxide. It is also best to introduce it at a point remote from the exit of the compartment so as to preclude rapid loss of it from the cell.

Addition of ferrite in a strong aqueous caustic solution to the catholyte of an operating chloralkali cell may result in a brief but temporary rise in cell voltage, believed to be due to increased foaming in the cathode compartment caused by the concentrated caustic. Lowering the cell voltage to below that before the ferrite addition is observed after about 1 to 16 hours following the ferrite addition.

The activated cathode so made carries a black deposit which can easily be rubbed from the substrate which carries the deposit, yet the deposit is sufficiently adherent that the cathode can be removed from the cell and replaced without unduly disturbing the deposit.

The advantages of the present invention over the methods of the prior art are that the present method is rapid, convenient, reproducible and inexpensive; it requires only a single addition to produce a lasting effect, rather than continuous or repeated addition; it does not require auxiliary apparatus for recirculating the modifier solution through the cell; and there is minimal contamination of the product caustic since no complexing agent, such as tartrate, and no auxiliary low overvoltage metal, such as nickel, chromium or molybdenum, is used in combination with the iron.

Inasmuch as the cathode of a chloralkali cell is negatively charged, it is surprising that use of negatively charged ferrite ions is highly effective in bringing about activation of the cathode. One would expect ferrite ions to migrate under the influence of the applied electrical potential to the membrane, and perhaps to stain it, yet no staining occurred.

To further illustrate the innovative aspects of the present invention, the following examples are provided.

PREPARATION OF SODIUM FERRITE SOLUTION

To 400 ml of 50% aqueous sodium hydroxide solution was added 8 g of fine iron powder, and the mixture was heated to reflux at approx. 142° C. for 16 hours. The mixture was filtered to remove undissolved iron, which amounted to 6 g; thus 2 g of iron had reacted. The clear filtrate, having the dark blue-green color characteristic of the ferrite ion, was diluted with deionized water to a concentration of approximately 40% sodium hydroxide, and was stored under a nitrogen atmosphere. For reasons not understood, this procedure has sometimes failed to provide a blue-green ferrite solution, but has given a yellow-green solution which is not effective for making an iron-activated cathode. The method is essentially that reported by Cotton & Wilkinson, Advanced Inorganic Chemistry, Interscience, 1972, p. 860, for making blue-green crystals of $Na_4[Fe(OH)_6]$.

EXAMPLES 1 TO 4

In these examples, a small chloralkali cell was used which included a glass anode chamber and an acrylic plastic cathode chamber, and an anode and a cathode spaced approximately 2 to 3 mm apart and separated by an ion-exchange membrane. The anode was a dimensionally stable anode coated with ruthenium oxide and titanium dioxide. The membrane consisted of a layer 51 microns (2 mils) thick of a copolymer of methyl perfluoro(4,7-dioxa-5-methyl-8-nonenoate) and tetrafluoroethylene having an equivalent weight of 1050 and a layer 152 microns (6 mils) thick of a copolymer of perfluoro(3,6-dioxa-4-methyl-7-octenesulfonyl fluoride) and tetrafluoroethylene having an equivalent weight of 1100, having a fabric of fluorocarbon monofilaments therein predominantly in the sulfonyl polymer layer, and hydrolyzed so as to have carboxylic and sulfonic acid groups in the form of their sodium salts, and placed in the cell with the carboxylic layer disposed toward the cathode. The anode compartment was fed with saturated sodium chloride solution purified by ion exchange to lower calcium ion concentration to below 50 parts per billion, and the cathode compartment was fed with water (dilute caustic during startup of the cell), at such rates as to produce 10 N caustic; electrolysis was carried out at 90° C. and 3 kA/m$^2$ (2 Asi), and exit brine depleted to 200 g/l.

With the cell in operation at steady state, producing caustic and hydrogen in the cathode compartment and chlorine in the anode compartment, ferrite solution as described immediately above was introduced into the cathode compartment with a peristaltic pump through a tube leading to a point under the surface of the catholyte liquor and near the center of the cathode. Typically, the cell voltage increased by about 1.0 to 0.3 volts during this addition of ferrite, which is believed to be attributable to the increased amount of foaming in the cathode chamber caused by addition of the concentrated caustic solution, but this voltage increase vanished rapidly when the feed was stopped, and over 1 to 16 hours the voltage continued to decrease to a value below its initial steady-state value. Data for Examples 1 to 4 is summarized in Table 1.

TABLE 1

| Ex. | Cathode | Ferrite solution added (ml) | Voltage before addition | Voltage after addition | Voltage improvement | Days |
|---|---|---|---|---|---|---|
| 1 | Ni plated | 300 | 3.94 | 3.63 | 0.31 | 10 |
| 2 | Mild steel | 350 | 3.66 | 3.56 | 0.10 | 11 |
| 3 | Ni plated | 250 | 4.03 | 3.63 | 0.40 | 9 |
| 4 | Ni plated | 6 | 3.72 | 3.55 | 0.17 | 25 |

In Examples 1 to 3, the ferrite solution was introduced over a period of several hours. The concentration of the ferrite solution was such that 100 ml contains 0.4 g of sodium ferrite, or 85 mg of iron. Example 4, the ferrite solution was added over a period of 10 minutes.

In Example 1, the mild steel cathode substrate had four mild steel 3-mm spacers welded to it on its side which would face the membrane, and the resulting cathode/spacer assembly was nickel plated. In Examples 2 to 4, no spacers were used.

Upon disassembly of the cell at the end of each experiment, a black deposit was found on the surface of the cathode; the deposit is easily removed by rubbing, and a cathode with such deposit must be handled carefully if the deposit is not to be disturbed.

In Example 3, after 6 days the cell was shut down for 6 hours, then restarted, and again ran at 3.63 volts for 3 days before it was shut down.

In Example 4, at the end of 25 days, a leaking gasket required that the cell be shut down and disassembled; upon disassembly, part of the iron deposit on the cathode is believed to have been lost, so the cathode was intentionally cleaned of the iron deposited on it. On reassembly with the cleaned cathode and startup, the voltage was near the value before ferrite addition, but upon addition of ferrite solution, the voltage again dropped, to 3.60 volts, and for another 53 days the cell operated with no deterioration in performance and was then shut down.

In none of the above examples was the cell shut down because of any deterioration in the performance of the activated cathode. All shut-downs were intentional, to make the cell available for another experiment, or to analyze the deposit on the cathode.

In Example 1, after termination of the experiment, the cathode was removed from the cell and gently washed with water. An X-ray powder pattern of the cathode coating was made, and showed that the coating was a 50:50 (approx.) mixture of alpha-Fe° and iron oxide.

INDUSTRIAL APPLICABILITY

The invention is useful broadly in the chloralkali industry for providing a more efficient and economical operation of chloralkali cells. For example, for a plant producing 1000 metric tons of caustic per day, operating at 95% current efficiency with power costs of $0.05/kilowatt hour, there is an annual savings of over $1,280,000 for each reduction in operating voltage of 0.1 volt. Beyond the actual monetary savings, there is also a corresponding saving in the world's energy reserves.

The process of making an iron-activated cathode, and the process of lowering hydrogen overvoltage in a chloralkali cell, both of which are aspects of the invention, are fast and efficient. Such processes are easily done at any time during cell operation. No interruption of electrolysis or delay in starting up a cell is required while activating the cathode, and recirculation of the modifier solution is not necessary. The improvement is effected with the use of a ferrite only; no other low overvoltage metal ions need be introduced in combination with the ferrite.

We claim:

1. In a process for electrolysis of brine in a chloroalkali cell which comprises an anode, a cathode, an anode compartment, a cathode compartment, and a fluorine-containing cation-exchange membrane which separates said compartments, the improvement comprising adding to said cathode compartment an aqueous solution containing ferrite ions.

2. The process of claim 1 wherein said cathode is nickel, stainless steel, mild steel or mild steel having a nickel surface.

3. The process of claim 2 wherein said cathode is nickel.

4. The process of claim 1 wherein said aqueous solution containing ferrite ions is a solution of sodium or potassium ferrite in aqueous caustic solution, said caustic solution being 40 to 50% caustic by weight.

5. The process of claim 4 wherein said solution of sodium or potassium ferrite contains from 0.1 to 5 g of iron per liter of solution.

6. The process of claim 5 wherein the said solution of sodium or potassium ferrite is added to said cathode compartment in an amount which contains 1 to 5 g of iron per $m^2$ of the included area of said cathode.

7. A method for lowering the operating voltage of a chloralkali electrolysis cell which comprises an anode, a cathode, an anode compartment, a cathode compartment, and a fluorine-containing cation-exchange membrane which separates said compartments, said method comprising introducing into said cathode compartment an aqueous solution containing ferrite ions.

8. The method of claim 7 wherein said cathode is nickel, stainless steel, mild steel or mild steel having a nickel surface.

9. The method of claim 8 wherein said cathode is nickel.

10. The method of claim 7 wherein said aqueous solution containing ferrite ions is a solution of sodium or potassium ferrite in aqueous caustic solution, said caustic solution being 40 to 50% caustic by weight.

11. The method of claim 10 wherein said solution of sodium or potassium ferrite contains from 0.1 to 5 g of iron per liter of solution.

12. The method of claim 11 wherein the said solution of sodium or potassium ferrite is added to said cathode compartment in an amount which contains 1 to 5 g of iron per $m^2$ of the included area of said cathode.

13. A process for making an iron-activated cathode from the cathode of a chloralkali cell which comprises an anode compartment, an anode situated within said anode compartment, a cathode compartment, a cathode situated within said cathode compartment, and a cation-exchange membrane between said anode compartment and said cathode compartment, said anode compartment containing aqueous brine solution, said cathode compartment containing aqueous caustic solution, said process comprising (a) introducing into said cathode compartment an aqueous solution containing ferrite ions, and (b) passing an electrical current between said anode and said cathode until a deposit comprising iron forms on the surface of said cathode.

14. The process of claim 13 wherein said cathode is nickel, stainless steel, mild steel or mild steel having a nickel surface.

15. The process of claim 14 wherein said cathode is nickel.

16. The process of claim 13 wherein said aqueous solution containing ferrite ions is a solution of sodium or potassium ferrite in aqueous caustic solution, said caustic solution being 40 to 50% caustic by weight.

17. The process of claim 16 wherein said solution of sodium or potassium ferrite contains from 0.1 to 5 g of iron per liter of solution.

18. The process of claim 17 wherein the said solution of sodium or potassium ferrite is added to said cathode compartment in an amount which contains 1 to 5 g of iron per $m^2$ of the included area of said cathode.

* * * * *